United States Patent [19]

Branston et al.

[11] Patent Number: 4,557,989

[45] Date of Patent: Dec. 10, 1985

[54] PHOTORESPONSIVE IMAGING MEMBERS WITH DIHYDROXY METAL PHTHALOCYANINE COMPOSITIONS

[75] Inventors: Randolph E. Branston; James M. Duff, both of Mississauga, Canada

[73] Assignee: Xerox Corporation, Stamford, Conn.

[21] Appl. No.: 650,381

[22] Filed: Sep. 13, 1984

[51] Int. Cl.[4] ..... G03G 5/06; G03G 5/14

[52] U.S. Cl. ..... 430/59; 430/58; 430/76; 430/78

[58] Field of Search ..... 430/58, 59, 76, 78

[56] References Cited

U.S. PATENT DOCUMENTS

| | | | |
|---|---|---|---|
| 3,094,535 | 6/1963 | Kenney et al. . | |
| 3,094,536 | 6/1963 | Kenney et al. . | |
| 3,816,118 | 6/1974 | Byrne . | |
| 3,895,944 | 7/1975 | Wiedemann et al. | 430/59 |
| 3,926,629 | 12/1975 | Weigl . | |
| 4,311,775 | 1/1982 | Regan | 430/78 X |
| 4,426,434 | 1/1984 | Arishima et al. | 430/128 |
| 4,443,528 | 4/1984 | Tamura et al. | 430/78 X |
| 4,471,039 | 9/1984 | Borsenberger et al. | 430/76 X |

FOREIGN PATENT DOCUMENTS

| | | | |
|---|---|---|---|
| 57-146255 | 9/1982 | Japan | 430/59 |
| 59-49544 | 3/1984 | Japan | 430/58 |

*Primary Examiner*—Roland E. Martin
*Attorney, Agent, or Firm*—E. O. Palazzo

[57] ABSTRACT

Disclosed is an improved layered photoresponsive imaging member comprised of (1) a supporting substrate, (2) a photogenerating layer comprised of a dihydroxymetallic phthalocyanine, especially those selected from the group consisting of dihydroxygermanium phthalocyanine, dihydroxytin phthalocyanine and dihydroxysilicon phthalocyanine, and (3) a diamine hole transport layer comprised of an arylamine dispersed in an inactive resinous binder composition.

11 Claims, 3 Drawing Figures

PHOTORESPONSIVE IMAGING MEMBERS WITH DIHYDROXY METAL PHTHALOCYANINE COMPOSITIONS

BACKGROUND OF THE INVENTION

This invention is generally directed to layered photoresponsive imaging members, and more specifically to imaging members having incorporated therein as photogenerating substances, certain dihydroxymetal phthalocyanines, especially dihydroxygermanium phthalocyanines. In one embodiment, the present invention envisions a layered photoresponsive imaging member comprised of a dihydroxygermanium phthalocyanine photogenerating composition, in contact with a hole transport layer. These members are useful for generating images in electrostatic latent imaging systems, and more specifically the imaging members of the present invention are sensitive to wavelengths in the infrared region of the spectrum, that is for example, wavelengths of from 800 to 900 nanometers.

Numerous different xerographic photoconductive members are known including, for example, a homogeneous layer of a single material such as vitreous selenium, or a composite layered device, containing a dispersion of a photoconductive composition. An example of a composite xerographic photoconductive member is described in U.S. Pat. No. 3,121,006, wherein there is disclosed finely divided particles of a photoconductive inorganic compound dispersed in an electrically insulating organic resin binder. The binder materials disclosed in this patent comprise a material which is incapable of transporting for any significant distance injected charge carriers generated by the photoconductive particles. Accordingly, as a result, the photoconductive particles must be in a substantially contiguous particle-to-particle contact throughout the layer for the purpose of permitting charge dissipation required for a cyclic operation. Thus, with the uniform dispersion of photoconductive particles described, a relatively high volume concentration of photoconductor material, about 50 percent by volume, is usually necessary in order to obtain sufficient photoconductor particle-to-particle contact for rapid discharge. This high photoconductive loading can result in destroying the physical continuity of the resinous binder, thus significantly reducing the mechanical properties thereof. Illustrative examples of specific binder materials disclosed in the '006 patent include, for example, polycarbonate resins, polyester resins, and polyamide resins.

There are also known photoreceptor materials comprised of inorganic or organic materials wherein the charge carrier generating, and charge carrier transport functions, are accomplished by discrete contiguous layers. Additionally, layered photoreceptor materials are disclosed in the prior art which include an overcoating layer of an electrically insulating polymeric material. However, the art of xerography continues to advance and more stringent demands need to be met by the copying apparatus in order to increase performance standards, and to obtain higher quality images. Also, there is desired layered photoresponsive imaging members which are responsive to infrared illumination selected for laser printing systems.

Further, recently there has been disclosed other photoresponsive devices including those comprised of separate generating layers, and amine transport layers as described in U.S. Pat. No. 4,265,990, and overcoated photoresponsive materials containing a hole injecting layer, overcoated with a hole transport layer, followed by an overcoating of a photogenerating layer, and a top coating of an insulating organic resin, reference U.S. Pat. No. 4,251,612. Examples of photogenerating compositions disclosed in these patents include trigonal selenium and phthalocyanines. The disclosures of each of these patents, namely, U.S. Pat. Nos. 4,265,990 and 4,251,612 are totally incorporated herein by reference.

Furthermore, there is disclosed in U.S. Pat. Nos. 4,232,102 and 4,233,383, photoresponsive imaging members comprised of trigonal selenium doped with sodium carbonate, sodium selenite, and trigonal selenium doped with barium carbonate, and barium selenite or mixtures thereof.

There is also known layered photoresponsive imaging members sensitive to visible light and/or infrared radiation, reference for example U.S. Pat. No. 4,415,639, the disclosure of which is totally incorporated herein by reference. In this patent there is disclosed a layered photoresponsive imaging member comprised of a photogenerating layer, a photoconductive layer, and a hole transport layer. More specifically, there is illustrated in this patent an improved photoresponsive imaging member comprised of a supporting substrate, a hole blocking layer, an optional adhesive interface layer, an inorganic photogenerating layer, a photoconductive composition capable of enhancing or reducing the intrinsic properties of the photogenerating layer, and a hole transport layer. As photoconductive compositions for this device there can be selected various squaraine pigments, including hydroxy squaraine compositions. Moreover, there is disclosed in U.S. Pat. No. 3,824,099, certain photosensitive hydroxy squaraine compositions. According to the disclosing of this patent the squaraine compositions are photosensitive to normal electrostatographic imaging systems.

While the above-described photoresponsive imaging members are suitable for their intended purposes, there continues to be a need for improved members, particularly those which are sensitive to infrared radiation. Additionally, there is a need for imaging members having incorporated therein phthalocyanine compositions which are relatively nontoxic, and can be easily prepared and purified. Moreover, there continues to be a need for imaging members having incorporated therein photogenerating layers comprised of phthalocyanine compositions that can be prepared by simple processes. Also, there is a need for imaging members possessing desirable sensitivity, particularly in the wavelength region of from 800 to 900 nanometers, low dark decay characteristics, high charge acceptance values, and wherein these members can be selected for repeated cycling in a xerographic imaging apparatus. There also is a need for improved layered imaging members wherein the photogenerating pigment selected for one of the layers is substantially inert to users of an imaging apparatus with these members. Furthermore, there continues to be a need for improved infrared sensitive layered photoresponsive imaging members useful in a number of imaging and printing systems wherein lasers, such as gallium arsenide aluminum lasers, are selected.

SUMMARY OF THE INVENTION

It is thus an object of the present invention to provide improved layered photoresponsive imaging members with sensitivity to infrared radiation.

It is another object of the present invention to provide improved photoresponsive imaging members containing as photogenerating pigments dihydroxymetal phthalocyanines.

It is yet another object of the present invention to provide improved layered photoresponsive imaging members comprised of a hole transport layer, and in contact therewith a photogenerating layer comprised of dihydroxygermanium phthalocyanines, and other similar metallic phthalocyanines.

In still another object of the present invention there are provided layered imaging members with desired photosensitivity in the infrared region, low dark decay characteristics, and high charge acceptance values.

In yet another object of the present invention there are provided simple economically attractive processes for effecting preparation of dihydroxymetallic phthalocyanines selected as photogenerating pigments for the imaging members of the present invention.

In yet another object of the present invention, there are provided imaging and printing methods with the improved photoresponsive imaging members described herein.

These and other objects of the present invention are accomplished by the provision of an improved layered photoresponsive imaging member having incorporated therein dihydroxymetal phthalocyanines. More specifically, in accordance with the present invention there is provided an improved layered photoresponsive imaging member comprised of a dihydroxygermanium phthalocyanine photogenerating layer, and in contact therewith a hole transport layer. In one specific embodiment of the present invention the imaging member is comprised of a supporting substrate, a photogenerating layer of dihydroxygermanium phthalocyanine, and as a top layer in contact with the photogenerating layer a hole transport layer comprised of aryl amines dispersed in an inactive resinous binder composition.

The dihydroxymetal phthalocyanines selected for use as the photogenerating pigments are readily available materials. They nevertheless can be prepared by a simple two step process for enabling imaging members with these compositions to possess excellent sensitivity in the infrared region of the spectrum, particularly from about 830 to 900 nanometers, with a peak sensitivity of 890 nanometers. Thus, the dihydroxygermanium phthalocyanines can be prepared by reacting germanium tetrachloride with phthalonitrile, or 1,3-diiminoisoindolenine at elevated temperatures. Thereafter, the resulting dihychlorogermanium phthalocyanine is added to sulfuric acid at room temperature and poured onto ice, wherein there is obtained the desired dihydroxygermanium phthalocyanine subsequent to filtration and washing. In an alternative process embodiment, dihydroxygermanium phthalocyanine can be obtained by the hydrolysis of dichlorogermanium phthalocyanine with concentrated ammonium hydroxide.

Purification to improve photogeneration of the products obtained can be accomplished by known methods including the addition of the dihydroxymetal phthalocyanine powder generated to a mixture of pyridine and ammonium hydroxide, followed by refluxing.

The intermediate dichlorogermanium phthalocyanine can also be prepared by metal insertion synthesis wherein, for example, a metal free phthalocyanine, inclusive of X-metal free phthalocyanine is mixed with quinoline, followed by the addition of germanium tetrachloride. Thereafter, the mixture is heated and subsequently cooled to room temperature. An additional amount of germanium tetrachloride is added to the mixture, followed by further heating and cooling. There resulted after filtration the dichlorogermanium phthalocyanine product.

In one preferred preparation sequence, a dihydroxygermanium phthalocyanine photogenerating pigment can be prepared by reacting from about 0.5 moles to about 2 moles of germanium tetrachloride with about 2.0 moles to about 8 moles of a suitable organic nitrogen containing compound such as phthalonitrile. This reaction is effected at a temperature of from about 230° C. to about 240° C. Following filtration and washing with boiling dimethyl formamide, and other similar solvents, these results dichlorogermanium phthalocyanine. Thereafter, the dichlorogermanium phthalocyanine, in an amount of from about 0.1 moles to about 0.2 moles, is added to a strong acid, inclusive of sulfuric acid, in an amount of from about 800 milliliters to about 1,500 milliliters. After stirring this mixture at room temperature, it is poured into crushed ice. Subsequent to filtration and washing there results a high purity dihydroxygermanium phthalocyanine, as determined by absorption spectra, and elemental analysis.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1:
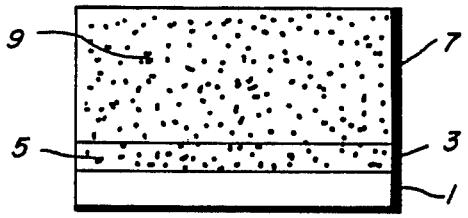
FIG. 1 is a partially schematic cross sectional view of the photoresponsive imaging member of the present invention.

Illustrated in FIG. 1 is a photoresponsive imaging member of the present invention comprised of a supporting substrate 1, a photogenerating layer 3, comprised of the photogenerating pigment dihydroxygermanium phthalocyanine, dihydroxytin phthalocyanine, or dihydroxysilicon phthalocyanine, optionally dispersed in a resinous binder composition 5, and a charge carrier hole transport layer 7, dispersed in an inactive resinous binder composition 9.

Figure 2:
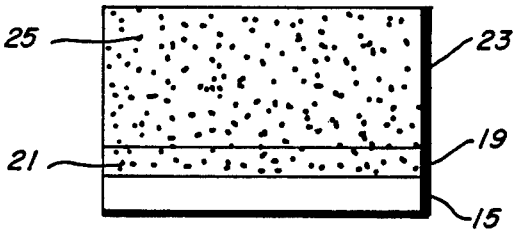
FIG. 2 is a partially schematic cross sectional view of another photoresponsive imaging member of the present invention.

Illustrated in FIG. 2 is a preferred photoresponsive imaging member of the present invention comprised of a conductive supporting substrate 15, a photogenerating layer 19, comprised of the photogenerating pigment dihydroxygermanium phthalocyanine, optionally dispersed in a resinous binder composition 21, and a charge carrier hole transport layer 23, comprised of an arylamine hole transporting substance, dispersed in a polycarbonate resinous binder composition 25.

Figure 3:
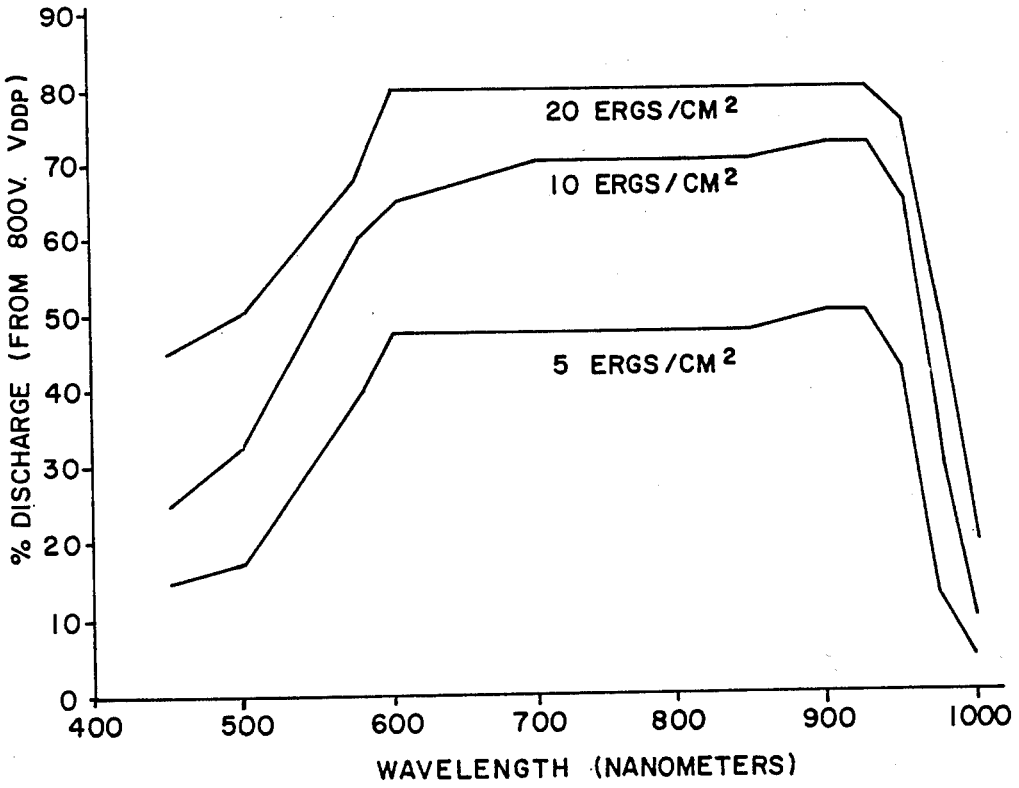
FIG. 3 is a line graph illustrating the percent discharge as a function of wavelength for the imaging member prepared in accordance with Example III.

Illustrated in FIG. 3 is a line graph detailing the photosensitivity of the dihydroxygermanium phthalocyanine. More specifically, there is illustrated in this line graph plotted curves of percent discharge versus wavelength for three different values of exposure, namely, 5, 10 and 20 ergs per square centimeter. These curves were derived from data obtained from an imaging member of the type as illustrated in FIG. 2.

With further specific reference to the Figures, the substrate layers may be opaque or substantially transparent, and may comprise any suitable material having the requisite mechanical properties. Thus, the substrate may comprise a layer of insulating material inclusive of certain inorganic or organic polymeric materials, such as Mylar, a commercially available polymer; a layer of an organic or inorganic material having a semiconductive surface layer such as aluminum arranged thereon, or a conductive material including, for example, aluminum, chromium, nickel, brass or the like. The substrate may be flexible or rigid and may have a number of many different configurations such as, for example, a plate, a cylindrical drum, a scroll, an endless flexible belt and the like. Preferably, the substrate is in the form of an endless flexible belt. In some situations it may be desirable to coat on the back of the substrate, particularly when the substrate is an organic polymeric material, an anti-curl layer including, for example, polycarbonate materials commercially available as Makrolon.

The thickness of the substrate layer depends on many factors, including economical considerations, thus this layer may be of substantial thickness, for example, over 100 mils, or of a minimum thickness, providing the objectives of the present invention are achieved. In one preferred embodiment, the thickness of this layer is from about 3 mils to about 10 mils.

The photogenerating layer can be comprised of 100 percent by weight of the dihydroxy phthalocyanine, or this pigment may be dispersed in various suitable resinous polymer binder materials, in amounts of from about 5 percent by weight to about 95 percent by weight, and preferably from about 25 percent by weight to about 75 percent by weight. Illustrative examples of polymeric binder resinous materials that can be selected include those as disclosed in U.S. Pat. No. 3,121,006, the disclosure of which is totally incorporated herein by reference, polyesters, polyvinyl butyral, Formvar®, polycarbonate resins, polyvinyl carbazole, epoxy resins, and phenoxy resins, especially the commercially available poly(hydroxyether)resins. This layer is generally of a thickness of from about 0.1 microns to about 2 microns, and preferably is of a thickness of from about 0.3 microns to about 0.8 microns.

The charge carrier, or hole transport layer, generally having a thickness in the range of from about 5 microns to about 50 microns, and preferably from about 20 microns to about 40 microns can be comprised of a number of suitable materials which are capable of transporting holes. In a preferred embodiment, the transport layer comprises molecules of the formula:

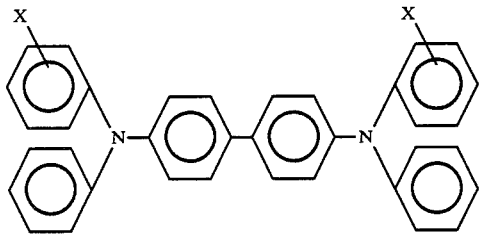

dispersed in a highly insulating and transparent organic resinous binder wherein X is selected from the group consisting of alkyl, and halo, especially (ortho) $CH_3$, (meta) $CH_3$, (para) $CH_3$, (ortho) Cl, (meta) Cl, (para) Cl. The highly insulating resin, which has a resistivity of at least $10^{12}$ ohm-cm to prevent undue dark decay, is a material which is not necessarily capable of supporting the injection of holes from the photogenerating layer, and is not capable of allowing the transport of these holes through the material. However, the resin becomes electrically active when it contains from about 10 to 75 weight percent of the substituted N,N,N',N'-tetraphenyl[1,1-biphenyl]-4,4'-diamines corresponding to the foregoing formula.

Compounds corresponding to the above formula include, for example, N,N'-diphenyl-N,N'-bis(alkylphenyl)-[1,1-biphenyl]-4,4'-diamine wherein the alkyl is selected form the group consisting of methyl such as 2-methyl, 3-methyl and 4-methyl, ethyl, propyl, butyl, hexyl and the like. With chloro substitution, the amine is N,N'-diphenyl-N,N'-bis(halo phenyl)-[1,1'-biphenyl]-4,4'-diamine wherein the halo atom is 2-chloro, 3-chloro or 4-chloro.

Other electrically active small molecules which can be dispersed in the electrically inactive resin to form a layer which will transport holes include, bis(4-diethylamino-2-methylphenyl)phenylmethane; 4',4''-bis(-diethylamine)-2',2''-dimethyltriphenyl methane; bis-4(diethylamino phenyl)phenylmethane; and 4,4'-bis(diethylamino)-2,2'-dimethyl triphenylmethane.

Examples of inactive binder resins for the transport layer include those compositions as described in U.S. Pat. No. 3,121,006, the disclosure of which is totally incorporated herein by reference. Specific examples of organic resinous materials are polycarbonates, acrylate polymers, vinyl polymers, cellulose polymers, polyesters, polysiloxanes, polyamides, polyurethanes, and epoxies, as well as block, random or alternating copolymers thereof. Preferred electrically inactive binder materials are polycarbonate resins with a molecular weight (Mw) of from about 20,000 to about 100,000, and preferably of from about 50,000 to about 100,000. Generally, the resinous binder is comprised of from about 10 to about 75 percent by weight, and preferably from about 35 percent to about 50 percent of the active material corresponding to the foregoing formula.

Also included within the scope of the present invention are methods of imaging, particularly xerographic imaging with the photoresponsive imaging members illustrated herein. These methods generally involve the formation of an electrostatic latent image on the photoconductive member, followed by developing this image with a toner composition, subsequently transferring the image to a suitable substrate, and permanently affixing the image thereto. The imaging members of the present invention are especially useful with, for example, gallium arsenide laser systems, in that the photo-generating substance is sensitive to infrared radiation in a wavelength of from about 800 to about 900 nanometers, thus enabling the imaging member to be selected for printing systems.

The invention will now be described in detail with reference to specific preferred embodiments thereof, it being understood that these examples are intended to be illustrative only. The invention is not intended to be limited to the materials, conditions, or process parameters recited herein, it being noted that all parts and percentages are by weight unless otherwise indicated.

EXAMPLE I

Dihydroxygermanium phthalocyanine was prepared by the reaction of dichlorogermanium phthalocyanine with sulfuric acid. Specifically, there was prepared dichlorogermanium phthalocyanine by reacting germanium tetrachloride, 100 grams, 0.466 moles, with a stirring suspension of phthalonitrile, 250 grams, 1.95 moles in quinoline (dried over 4A molecular sieves) in a two liter, 3-neck round bottom flask fitted with an air cooled condenser, mechanical stirrer and thermometer. The resulting mixture was slowly heated until reflux was initiated. Subsequent to refluxing for 2.5 hours, the mixture was allowed to cool to about 100° C., followed by filtering through a sintered glass funnel. The crude product was then washed with five 100 millimeter portions of boiling dimethylformamide, and with 500 milliliters of methanol. There resulted 52.5 grams of dark blue needles of dichlorogermanium phthalocyanine in 17 percent yield.

The dichlorogermanium phthalocyanine was also prepared by a metal insertion synthesis, by adding to 400 milliliters of dried quinoline in a 1 liter three necked round bottom flask fitted with a mechanical stirrer, thermometer, air-cooled condenser, and gas inlet, 41 grams, 0.08 moles, of metal free phthalocyanine, which had been ground in an analytical mill. The flask was then purged with nitrogen for 15 minutes, followed by the addition of 10 milliliters, 0.086 moles of germanium tetrachloride. Heat was applied to the viscous mixture, followed by refluxing for 2 hours. Subsequent to cooling to about 70° C., 2 milliliters, 0.017 moles of germanium tetrachloride was added to the reaction mixture, followed by refluxing for an additional 2 hours. Thereafter, the reaction mixture was cooled to 80° C., and subjected to filtration. The resulting crude product was washed with 200 milliliter aliquots of boiling dimethyl formamide until the washings were almost colorless. The solid product was washed with three 200 milliliter aliquots of acetone, and dried in an 80° C. oven overnight. There resulted 43.2 grams, 82 percent yield, of purple crystals of dichlorogermanium phthalocyanine.

There was then prepared a dihydroxygermanium phthalocyanine by the sulfuric acid method, and the base hydrolysis method.

In the sulfuric method, dichlorogermanium phthalocyanine, 56 grams, 0.086 moles as prepared in accordance with the metal insertion synthesis described herein, was added to 750 milliliters of concentrated sulfuric acid in a 1 liter Erlenmeyer flask. The reaction mixture was subjected to continuous stirring, while slowly adding thereto small amounts of the crystalline dichlorogermanium phthalocyanine. Additionally, the hydrogen chloride gas evolution was allowed to subside prior to adding succeeding amounts of the crystalline pigment. This addition was completed in 30 minutes, and the resulting black solution was stirred at room temperature for 4 hours. Thereafter, the solution obtained was very slowly poured onto 4.5 kilograms of stirred crushed ice. There resulted a blue suspension which was filtered through a three liter sintered glass funnel. This filtration proceeded very slowly in view of the small particle size of the resulting particles, less than 0.5 microns. There resulted a solid cake product which was slurried twice in 1 liter of water and filtered. The blue pigment was then washed with 1 liter of water adjusted to a pH of 10 with aqueous ammonium, followed by washing with 500 milliliters of acetone. Following another washing with 2 liters of water, the product was dried, yielding dihydroxygermanium phthalocyanine, 38.2 grams, 86 percent yield, fine blue powder, identified by absorption spectra, and elemental analysis.

Dihydroxygermanium phthalocyanine was also prepared by the basic hydrolysis of the dichlorogermanium phthalocyanine obtained from the metal insertion synthesis disclosed herein. Thus, dichlorogermanium phthalocyanine, 40 grams, 0.0610 mole, was added to a mixture of pyridine, 870 milliliters, and 200 milliliters of concentrated ammonium hydroxide in a 2 liter, 3-necked round bottom flask fitted with a mechanical stirrer, and a water-cooled condenser. The purple suspension resulting was refluxed for 3 hours, and then 100 milliliters of water was added to the reaction mixture, and refluxing was continued for another 2 hours. Thereafter, the reaction mixture was cooled, filtered, and washed with five 200 milliliter portions of water, and two 200 milliliter portions of acetone. There resulted 37.25 grams, 98.7 percent yield, of a purple blue dihydroxygermanium phthalocyanine powder, identified by absorption spectra, and elemental analysis.

EXAMPLE II

The dihydroxygermanium phthalocyanine obtained in Example I can be further purified. Thus the dihydroxygermanium phthalocyanine prepared by the sulfuric acid method disclosed herein was ground with a mortar and pestle, ten and two-tenths (10.2), 0.016 moles of the resulting powder was then added to a mixture of pyridine, 125 milliliters, and 60 milliliters of concentrated ammonium hydroxide, stirring in 300 milliliter 3-necked round bottom flask fitted with a mechanical stirrer in a water-cooled condenser. The resulting navy blue suspension was refluxed for 1.5 hours. This suspension became very viscous and small amounts of water were added to the mixture in order that a reasonable stirring speed could be maintained. When the mixture had been refluxed for 5 hours, heating was discontinued, and the resulting blue suspension was filtered. The dihydroxygermanium phthalocyanine product was then washed with four 200 milliliter portions of water, and two 200 milliliter portions of acetone. Subsequent to drying there resulted 9.4 grams, 92 percent yield, of dihydroxygermanium phthalocyanine. Elemental analysis for this product indicated the following:

Analysis calculated for $C_{32}H_{18}N_8O_2Ge$: C, 62.09; H 2.93; N, 18.09; GE, 11.73. Found: C, 61.88; H, 2.78; N, 18.09; GE, 11.80.

The absorption spectrum of the dihydroxygermanium phthalocyanine in a polyvinylacetate film evidenced a strong infrared absorption peak at 875 nanometers.

EXAMPLE III

A photoresponsive imaging member was prepared by providing an aluminized Mylar substrate of a thickness of 3 mils, followed by applying thereto with a multiple clearance film applicator, in a wet thickness of 0.5 mils, a layer of 3-aminopropyltrimethoxysilane available from PCR Research Chemicals, Florida, in ethanol, in a 1:50 volume ratio. This layer was then allowed to dry for 5 minutes at room temperature, followed by curing for 10 minutes at 110° C. in a forced air oven.

Subsequently, there was applied a photogenerating layer of the dihydroxygermanium phthalocyanine as prepared in accordance with Example II, as follows:

In a separate 2 oz. amber bottle there was added 0.35 grams of the dihydroxygermanium phthalocyanine, 0.75 grams of Vitel PE-200®, a polyester available from Goodyear, 70 grams of ⅛" stainless steel shot, and 16.34 grams of methyl ethyl ketone/toluene solvent mixture, in a 4:1 volume ratio. The above mixture was placed on a ball mill for 24 hours. The resulting slurry was then coated on the silane with a multiple clearance film applicator to a wet thickness of 1 mil. The imaging member was then allowed to dry for 5 minutes, and the resulting device was dried at 135° C. for 6 minutes in a forced air oven. the dry thickness of the photogenerating layer was 0.5 microns.

The above photogenerating layer was then overcoated with a charge transport layer, which was prepared as follows:

A transport layer composed of 50 percent by weight Makrolon®, a polycarbonate resin available from Bayer A. G., was mixed with 50 percent by weight N,N'-diphenyl-N,N'-bis(3-methylphenyl)-1,1'-biphenyl-4,4'-diamine. This solution was mixed to 9 percent by weight in methylene chloride. All of these components were placed in an amber bottle and dissolved. This mixture was then coated yielding on top of the above photogenerator layer, using a multiple clearance film applicator, a layer with a dry thickness of 30 microns (15 mils wet gap thickness). The resulting device was then air dried at room temperature for 20 minutes and then in a forced air oven at 135° C. for 6 minutes.

The above prepared imaging member was then tested for photosensitivity in the infrared region of the spectrum by negatively charging with a corotron to −950 volts followed by simultaneously exposing to monochromatic light in a wavelength region of from about 400 to about 1,000 nanometers. The surface potential of the member was then measured with an electrical probe after exposure to these wavelengths. The extent of discharge, which indicates photoresponsiveness, was then measured.

The member had sufficient discharge so as to respond to light in a wavelength range of from 450 to about 950 nanometers, indicating both visible and infrared photosensitivity. The imaging member was particularly sensitive in the wavelength region of 750 to 950 nanometers, thus enabling the use of gallium arsenide laser devices for effecting generation of the latent electrostatic image.

EXAMPLE IV

Quinoline, 1140 milliliters, which was dried over 4A molecular sieves, was poured into a 2 liter 3-necked round bottom flask, maintained under a nitrogen atmosphere, and fitted with an air-cooled condenser, thermometer and mechanical stirrer. Diiminoisoindolenine, 100 grams, 0.68 mol, was added to the flask. Silicon tetrachloride, 113 milliliters, 0.99 mol, was added to the reaction mixture, which was then heated to reflux for 1.5 hours. Thereafter, the resulting crude product was hot filtered then washed with three 500 milliliter portions of boiling dimethylformamide, followed by washing with two 500 milliliter portions of methanol and 500 milliliters of water. The remaining purple crystals were stirred in 1 liter of water for 16 hours, then filtered off and washed with two 700 milliliter portions of methanol, followed by washing with three 700 milliliters of boiling dimethylformamide. Finally the product was washed with two 400 milliliters of methanol and dried in a vacuum oven, yielding 78.04 grams, 75.8 percent yield, of lustrous purple crystals of dichlorosilicon phthalocyanine, $PcSiCl_2$, as determined by elemental analysis.

EXAMPLE V

Concentrated ammonium hydroxide, 18 milliliters, was added to a mixture of 450 milliliters of water and 120 milliliters of pyridine stirring in a 1 liter round bottom flask, fitted with a mechanical stirrer and water-cooled condenser. Dichlorosilicon phthalocyanine, 20 grams, 0.033 mol, was added to the reaction flask and the resulting suspension was heated to reflux for 5 hours. Thereafter, reaction mixture was hot filtered and washed with three 100 milliliters of hot water followed by washing with three 50 milliliter portions of acetone. There resulted 11.9 grams, 63 percent yield, of purple crystals of dihydroxysilicon phthalocyanine.

Analysis: Calculated for: C, 66.95; H, 3.17; N, 19.51; Si, 4.89. Found: C, 66.85; H, 3.41; N, 19.49; Si, 4.65.

EXAMPLE VI

Tin (II) phthalocyanine, 9 grams, 0.0143 mol, and 4.71 grams of iodine, 0.0185 mol, were added to 500 milliliters of chloronaphthalene, stirring in a 1 liter round bottom flask fitted with a condenser and magnetic stirrer. The mixture was refluxed for 10 minutes, then was cooled to 160° C. at which point it was filtered. The remaining blue solid was washed with three 100 milliliter portions of chloronaphthalene followed by washing with three 100 milliliter portions of hot toluene and finally washing with three 100 milliliter portions of absolute ethanol. Subsequent to drying these resulted 10.9 grams, 86 percent yield of dihydroxytin phthalocyanine, identified by elemental analysis.

EXAMPLE VII

Diiodo tin phthalocyanine, 50 grams, 0.057 mol, was added to a mixture of 1,500 milliliters of water, 500 milliliters of 95 percent ethanol and 500 milliliters of concentrated ammonium hydroxide, stirring in a 3 liter round bottom flask fitted with a water-cooled condenser and a magnetic stirrer. The reaction mixture was heated to reflux for 2 hours, then was filtered. The dark purple-blue solid was washed with three 100 milliliter portion of water and three 100 milliliter portion of ethanol, then dried. Subsequent to drying, there resulted 6.8 grams, 93 percent yield of dihydroxytin phthalocyanine.

Imaging members may be prepared by repeating the procedure of Example III, with the exception that there is selected as the photogenerating pigments dihydroxysilicon phthalocyanine, and dihydroxytin phthalocyanine, obtained in accordance with the process illustrated in Examples IV, V, VI and VII.

Although the invention has been described with reference to specific preferred embodiments, it is not intended to be limited thereto, rather those skilled in the art will recognize that variations and modifications may be made therein which are within the spirit of the present invention and within the scope of the following claims.

We claim:

1. An improved layered photoresponsive imaging member comprised of (1) a supporting substrate, (2) a photogenerating layer comprised of a dihydroxymetallic phthalocyanine pigment selected from the group consisting of dihydroxygermanium phthalocyanine, dihydroxytin phthalocyanine and dihydroxysilicon phthalocyanine, and (3) a diamine hole transport layer comprised of an arylamine dispersed in an inactive resinous binder composition.

2. An imaging member in accordance with claim 1 wherein the diamine hole transport layer is situated between the supporting substrate and the photogenerating layer.

3. An imaging member in accordance with claim 1 wherein the photogenerating layer is situated between the supporting substrate, and the diamine hole transport layer.

4. An imaging member in accordance with claim 1 wherein the photogenerating layer is comprised of dihydroxygermanium phthalocyanine.

5. An imaging member in accordance with claim 1 wherein the supporting substrate is conductive.

6. An imaging member in accordance with claim 1 wherein the photogenerating pigment is dispersed in a resinous binder composition.

7. An imaging member in accordance with claim 6, wherein the resinous binder is selected from the group consisting of polyesters, polyvinylcarbazole, polyvinylbutyral, polycarbonates, and phenoxy resins.

8. An imaging member in accordance with claim 1 wherein arylamine hole transport composition comprises molecules of the formula:

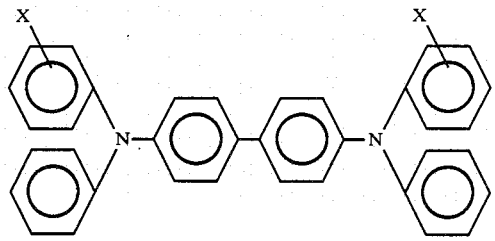

dispersed in a highly insulating and transparent organic resinous material wherein X is selected from the group consisting of alkyl groups, and halogen groups.

9. An imaging member in accordance with claim 8 wherein X is selected from the group consisting of ortho ($CH_3$), meta ($CH_3$), para ($CH_3$), ortho (Cl), metal (Cl), and para (Cl).

10. An imaging member in accordance with claim 8 wherein the resinous binder for the hole transport material is a polyester, a polycarbonate, or a vinyl polymer.

11. An imaging member in accordance with claim 8 wherein the diamine is comprised of N,N'-diphenyl-N,N'-bis(3-methylphenyl)-[1,1-biphenyl]-4,4'-diamine.

* * * * *